US005351961A

United States Patent [19]

Eulau

[11] Patent Number: 5,351,961

[45] Date of Patent: Oct. 4, 1994

[54] GOLF PUTTER ALIGNMENT AID

[76] Inventor: Steven D. Eulau, 82 Hawkins Ave., Smithtown, N.Y. 11787-3437

[21] Appl. No.: 45,716

[22] Filed: Apr. 14, 1993

[51] Int. Cl.[5] ..... A63B 69/36

[52] U.S. Cl. ..... 273/186.2

[58] Field of Search ..... 273/164.1, 186.2, 192, 273/194 A, 187.4, 163 R

[56] References Cited

U.S. PATENT DOCUMENTS

| | | | |
|---|---|---|---|
| 837,030 | 11/1906 | Blanchard | 273/164.1 |
| 3,730,529 | 5/1973 | Donofrio | 273/186.2 |
| 3,844,569 | 10/1974 | Swanson | 273/192 |
| 4,741,535 | 5/1988 | Leonhardt | 273/164.1 |
| 5,011,153 | 4/1991 | Watkins | 273/186.2 |

*Primary Examiner*—George J. Marlo
*Attorney, Agent, or Firm*—Michael I. Kroll

[57] ABSTRACT

A removable golf putter alignment device for a golf putter of the type having a grip, a shaft, a neck, a head with a front face between a toe and a heel and a sole. The device is connected to the front face of the head of the golf putter and includes a pair of curved extensions projecting forwardly and rearwardly from the golf putter with the rear extension having a pair of cross pieces for the purpose of spacing and rigidity and a single further rearward extension member to aid in sight alignment.

1 Claim, 2 Drawing Sheets

GOLF PUTTER ALIGNMENT AID

BACKGROUND OF THE INVENTION

1. Field of the Invention

The instant invention relates generally to golf equipment and more specifically it relates to a golf putter alignment aid device.

2. Description of the Prior Art

Numerous golf equipment have been provided in prior art that are adapted to assist golfers in gripping golf clubs, gauging or measuring distances and conditions, which might effect their play and in making strokes with the golf clubs. While these units may be suitable for the particular purpose to which they address, they would not be as suitable for the purposes of the present invention as heretofore described.

SUMMARY OF THE INVENTION

A primary object of the present invention is to provide a golf putter alignment aid device that will overcome the shortcomings of the prior art devices.

Another object is to provide a golf putter alignment aid device, which when removably attached to a front face of the putter, will encourage a correct pendulum motion needed for the putting stroke.

An additional object is to provide a golf putter alignment aid device that will guide the golfer to hit center when the putter lightly strokes the golf ball.

A further object is to provide a golf putter alignment aid device that is simple and easy to use.

A still further object is to provide a golf putter alignment aid device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
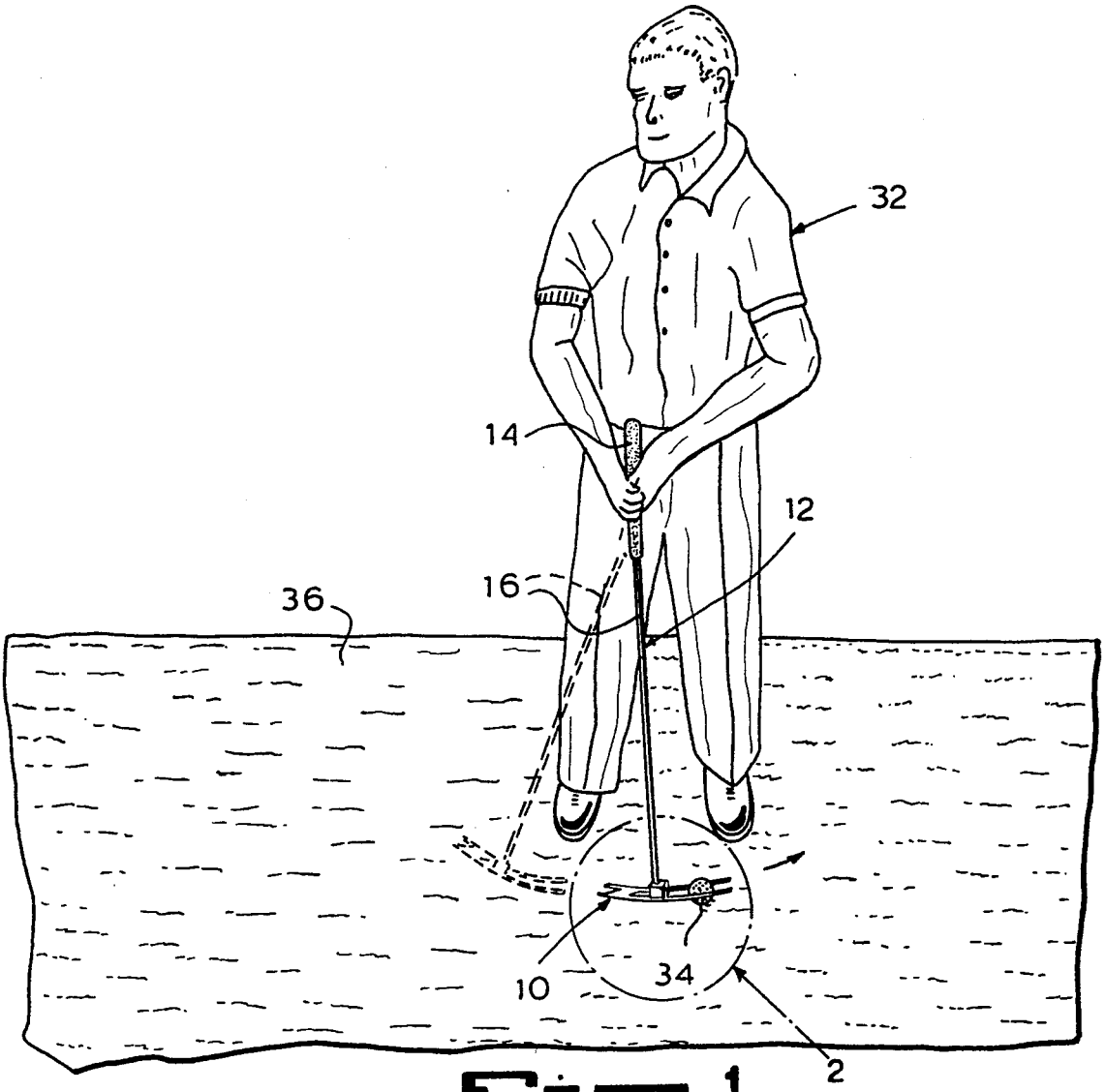
FIG. 1 is a perspective view showing the instant invention in use with a golf putter.
Figure 2:
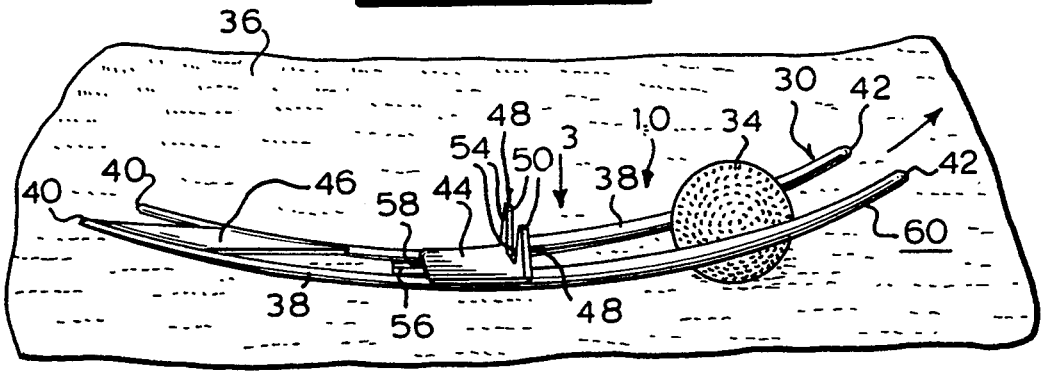
FIG. 2 is an enlarged perspective view as indicated by arrow 2 in FIG. 1, with the golf putter removed therefrom.
Figure 3:
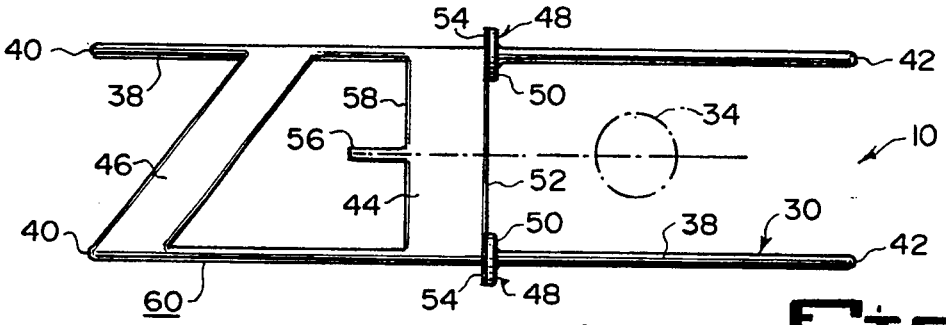
FIG. 3 is a top view as indicated by arrow 3 in FIG. 2.
Figure 4:
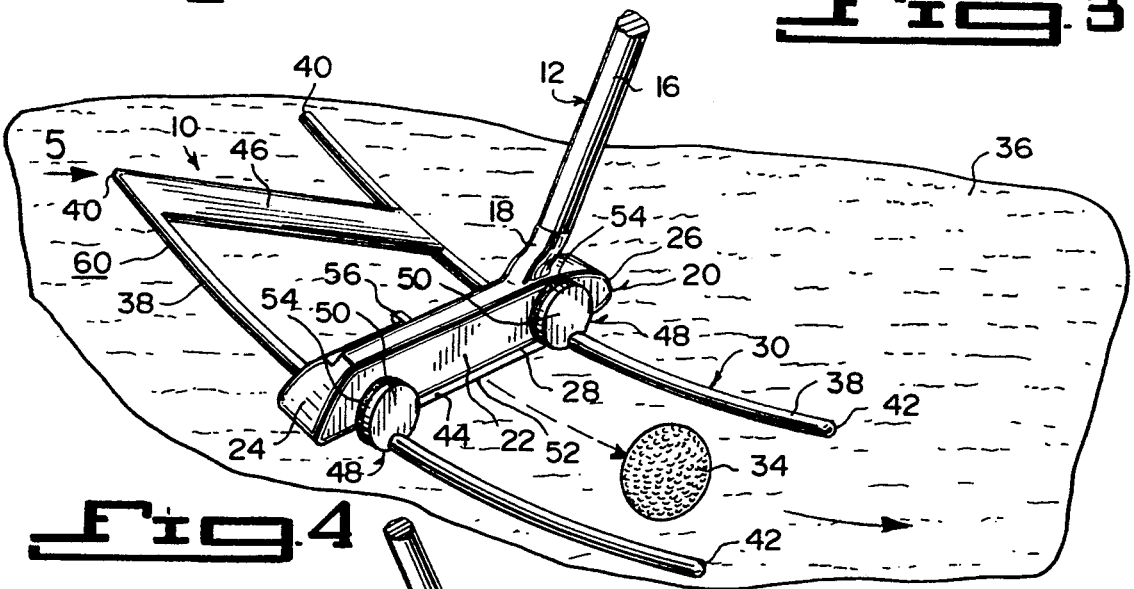
FIG. 4 is a front perspective view showing the instant invention installed on the golf putter ready to lightly stroke the golf ball.
Figure 5:
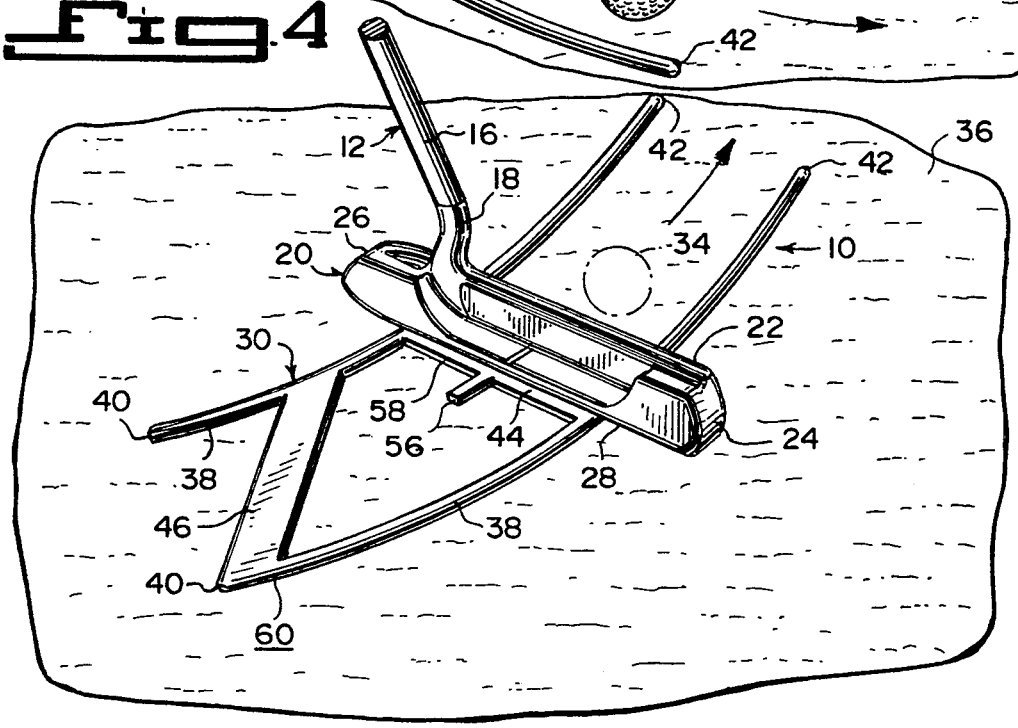
FIG. 5 is a rear perspective view taken in direction of arrow 5 in FIG. 4.

Turning now descriptively to the drawings, in which similar reference characters denote similar elements throughout the several views, FIGS. 1 through 5 illustrate a golf putter alignment aid device 10 for a golf putter 12 of the type having a grip 14, a shaft 16, a neck 18, a head 20 with a front face 22 between a toe 24 and a heel 26 and a sole 28. The device 10 consists of a structure 30 connected to the front face 22 of the head 20 of the golf putter 12, for encouraging a golfer 32 to produce a correct pendulum motion needed for a putting stroke against a golf ball 34 on a putting green 36 by the front face 22 of the head 20 of the golf putter 12.

The encouraging structure 30 includes a pair of curved runners 38, each having a tail end 40 and a nose end 42. A first crosspiece 44 extends generally at the center between the curved runners 38, so that the curved runners 38 are parallel to each other. The first crosspiece 44 is of a length to allow the golf ball 34 to fit between the nose ends 42 of the curved runners 38. A second crosspiece 46 extends at a diagonal between the curved runners 38 at the tail ends 40. Fasteners 48 are at the first crosspiece 44, for removably attaching the device 10 to the front face 22 of the head 20 of the golf putter 12.

The removably attaching fasteners 48 consists of a pair of pads 50, each affixed in a vertical position to one of the curved runners 30 at a forward edge 52 of the first crosspiece 44, so that the pads 50 are in a spaced apart relationship. A pair of double sided adhesive tabs 54 are provided. Each tab 54 is for attaching one pad 50 to the front face 22 of the head 20 of the golf putter 12 with the sole 28 resting on the first crosspiece 44.

Each pad 50 with the tab 54 are small disc shaped configurations. When attached against the front face 22 of the head of the golf putter 12, the golf ball 34 can contact the center of the front face 22 of the head 20 of the golf putter 12.

A guide finger 56 is affixed in a horizontal position at the center of a rearward edge 58 of the first crosspiece 44. The golfer 32 can visually guide the head 20 of the golf putter 12 to lightly stroke the golf ball 34 at the center of the front face 22 of the head 20 of the golf putter 12.

The curved runners 38, the first crosspiece 44, the second crosspiece 46, the pads 50 and the guide finger 56 are integral with each other, so as to form one complete unit 60 for the device 10. The one complete unit 60 is fabricated out of a durable strong material, which can be metal, plastic or metal coated with a plastic covering. The plastic covering can be color coordinated with respect to the golf putter 12 and the golfer 32.

To use the golf putter alignment aid device 10, the following steps should be taken:

1. Place the double sided adhesive tabs 54 against the pads 50.
2. Press the double sided adhesive tabs 54 against the front face 22 on the head 20 of the golf putter 12.
3. Grasp the grip 14 of the golf putter 12 and take a proper stance with respect to the golf ball 34.
4. Swing the golf putter 12, so that the curved runners 38 are centered by the guide finger 56 on opposite sides of the golf ball 34.
5. Lightly stroke the golf ball at the center of the front face 22 on the head 20 of the golf putter 12.
6. Remove the double sided adhesive tab 54 from the front face 22 on the head 20 of the golf putter 12, when the device 10 is no longer needed.

LIST OF REFERENCE NUMBERS

10 golf putter alignment aid device
12 golf putter
14 grip of 12
16 shaft of 12
18 neck of 12

20 head of 12
22 front face on 20
24 toe on 20
26 heel on 20
28 sole on 20
30 encouraging structure
32 golfer
34 golf ball
36 putting green
38 curved runner
40 tail end of 38
42 nose end of 38
44 first crosspiece
46 second crosspiece
48 fastener
50 pad
52 forward edge of 44
54 double sided adhesive tab
56 guide finger
58 rearward edge of 44
60 one complete unit for 10

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A golf putter alignment aid device for attachment to a golf putter of the type having a grip, a shaft, a neck, a head with a front face between a toe and a heel and a sole, said device comprising means for removably connecting the center portion of said device to the front face of the head of the golf putter, for encouraging a golfer to produce a correct pendulum motion needed for a putting stroke against a golf ball on a putting green by the front face of the head of the golf putter, a pair of curved, parallel, horizontally spaced apart, extensions projecting forwardly and rearwardly from the center portion of said device with the forward extensions adapted to be positioned on opposite sides of a golf ball being putted and the rear extensions having a pair of cross pieces for the purpose of spacing and rigidity and a single further rearward extension member to aid in sight alignment.

* * * * *